US006536360B2

(12) United States Patent
O'Connor

(10) Patent No.: US 6,536,360 B2
(45) Date of Patent: Mar. 25, 2003

(54) HEAT RECOVERY SYSTEM AND METHOD OF HEAT RECOVERY AND REUSE FOR A PORTABLE INCINERATION APPARATUS

(75) Inventor: Brian M. O'Connor, Palm City, FL (US)

(73) Assignee: Air Burners, LLC, Palm City, FL (US)

( * ) Notice: Subject to any disclaimer, the term of this patent is extended or adjusted under 35 U.S.C. 154(b) by 0 days.

(21) Appl. No.: 09/932,423

(22) Filed: Aug. 17, 2001

(65) Prior Publication Data

US 2003/0033966 A1 Feb. 20, 2003

(51) Int. Cl.[7] ..... F23B 7/00

(52) U.S. Cl. ..... 110/341; 110/241; 110/234; 110/233; 110/322

(58) Field of Search ..... 110/322, 324, 110/336, 341, 348, 241, 233, 234; 165/4

(56) References Cited

U.S. PATENT DOCUMENTS 3,314,668 A * 4/1967 Rosenak ..... 266/32
3,797,414 A * 3/1974 Ahrend ..... 110/8 R
3,843,106 A * 10/1974 Nanjyo et al. ..... 266/43
3,940,552 A * 2/1976 Mizuno ..... 13/35
4,221,922 A * 9/1980 Okimune ..... 13/32
4,445,442 A * 5/1984 Pollock ..... 110/171
4,615,283 A * 10/1986 Ciliberti et al. ..... 110/216
4,756,258 A 7/1988 Gilbert
4,763,584 A * 8/1988 Zieren ..... 110/323
4,771,709 A * 9/1988 Applegate ..... 110/235
4,889,061 A * 12/1989 Mcpherson et al. ..... 110/336
4,898,106 A * 2/1990 Bellew et al. ..... 110/346
5,415,113 A 5/1995 Wheeler et al.
5,619,935 A * 4/1997 Wilson ..... 110/241
5,673,634 A * 10/1997 Karger et al. ..... 110/234
5,727,482 A * 3/1998 Young ..... 110/244

* cited by examiner

*Primary Examiner*—Ira S. Lazarus
*Assistant Examiner*—K. B. Rinehart
(74) *Attorney, Agent, or Firm*—Hodgson Russ LLP

(57) ABSTRACT

A heat recovery system for an air curtain incinerator includes a transportable box defined by a plurality of walls and has an open top and an open bottom. The walls are lined with a refractory material operatively associated with the open bottom to form a combustion chamber. The system also includes a source of high velocity air and a manifold for directing an effective curtain of high velocity air across the top opening and down into the combustion chamber.

The heat recovery system comprises a system of tubing for conveying a heat conductive medium through the tubing during the combustion process. The tubing may be mounted to the walls, mounted inside the walls, or formed integrally in the walls.

18 Claims, 3 Drawing Sheets

HEAT RECOVERY SYSTEM AND METHOD OF HEAT RECOVERY AND REUSE FOR A PORTABLE INCINERATION APPARATUS

FIELD OF INVENTION

The present invention is directed to the disposal of waste and more particularly to a heat recovery system and a method of heat recovery and reuse for a self-contained transportable incineration apparatus.

BACKGROUND OF THE INVENTION

The disposal of waste such as trees, brush, yard waste, etc. is a major concern of the municipal, commercial and private sectors. Various types of recycling equipment and techniques are in use or have been proposed to dispose of such waste, all with varying degrees of success.

One method is to transport and to bury the waste in a landfill. However, landfill sites are becoming scarce and those remaining are cost prohibitive especially in rapidly growing urban areas. In addition, even if suitable sites can be found, they are often at a distance that makes transportation costs prohibitive. Since vegetation waste makes up approximately 40% of the bulk typically buried in landfills, most large cities require that the waste be separated from conventional garbage for purposes of mulch and compost manufacture in an effort to recycle the waste.

Each year there are tens of thousands of acres of land cleared of trees, brush, etc. for development and millions of tons of yard waste (small branches, leaves, grass, etc.) produced. Reducing the amount of such waste being buried or mulched would significantly reduce the pressure on the existing landfills and delay the need for opening new landfill sites. In addition, landfills are a relatively inefficient method of recycling. Being simply buried at one site, the economic potential of the waste material is never fulfilled. Also, solid waste landfills are diminishing rapidly and permits for new sites are difficult to secure.

Another waste material that presents challenges with regard to disposal is animal carcasses. In the past, diseased animal carcasses were usually buried and forgotten. Little was known about the agents that caused the deadly diseases which have wiped out many herds of cattle and entire chicken farms. It has been discovered that certain pathogens can survive for over fifty years in the soil where they have been buried along with animal carcasses that perished from the disease.

One alternative to landfills has been to incinerate the waste material. With regard to wood and vegetation wastes, this produces an ash residue which is extremely high in natural nutrients beneficial for plant growth. When the ash is mixed with compost and varying amounts of soil, a range of products from high-grade potting soil to top soil are developed. Open burning of the vegetation waste on site is the simplest and most cost effective way of incinerating the waste material. However, due to the many environmental limitations imposed by federal, state, and local jurisdictions, open burning is not always feasible or possible. With regard to the disposal of animal carcasses, the only known practical approach to the elimination of diseased carcasses is high temperature incineration.

Some open pit incineration has been made possible through the use of air curtain incinerators such as the device disclosed in U.S. Pat. No. 4,756,258. In an open pit incinerator, the waste is loaded into a fire pit through an opening and then ignited. High velocity air from a manifold positioned along the opening is then blown over and into the pit. The air flow pattern is intended to over-oxygenate the fire for more complete combustion and to provide a rotating mass of air that acts as a barrier or curtain to reduce the emission of smoke and ash from the fire.

A drawback of open pit incineration is the need for creation of the pit. This requires the employment of an earth mover and an operator familiar with pit construction. In many instances, neither an earth mover or a qualified operator is available and timber is incinerated in an open stance. This poses additional problems in that wind gusts could cause the loss of fire control.

Another drawback to open pit incineration is that the location of the pit may not always be convenient and therefore, transportation may be required. Over the road transport of waste materials is costly and in the case of diseased animals is undesirable for many reasons.

The problems associated with open burning and fire pits are addressed in U.S. Pat. No. 5,415,113, which is assigned to the assignee of the present invention. The patent discloses a portable incineration apparatus that provides an air curtain for reducing the emission of smoke and ash and to provide for more complete combustion of the waste materials. The apparatus provides a box having four walls with a top opening and a bottom opening. The inside of the walls are lined with a layer of a refractory material to form a combustion chamber. The incinerator also includes a source of high velocity air that is in air transfer communication with a manifold assembly. The manifold assembly is adapted to direct an effective sheet or curtain of high velocity air across the top of the opening and down into the combustion chamber and to maintain a substantially uniform discharge rate of the high velocity air as it exits the manifold assembly along the top opening. The high velocity air curtain covers the top opening and creates a rotational turbulence within the combustion chamber. It has been found that because of the substantially uniform discharge rate, the resulting curtain of high velocity air over the top opening limits the amount of particulate, such as ash, released into the atmosphere during combustion and virtually eliminates opacity or smoke.

The panels that make up the side walls of the apparatus weigh up to 1200 pounds each and are constructed of refractory materials rated to withstand temperatures to 2800° F. The temperature inside the combustion chamber approaches 2500° F. to 2800° F. To reach the optimum combustion temperatures as quickly as possible, the incinerator preferably includes a diesel and/or propane ignition system for igniting and fueling the combustion of the waste until these temperatures are achieved.

Given the temperatures and the amount of heat generated inside the combustion chamber of the portable incineration apparatus, there is a need for recovering and reusing some of the heat generated in the combustion chamber.

SUMMARY OF THE INVENTION

The present invention meets the above-described need by providing a heat recovery system and a method for recovering and reusing heat generated by a portable incineration apparatus.

The system provides a transportable box defined by four walls and having an open top and an open bottom. The walls are lined with a refractory material operatively associated with the open bottom to form a combustion chamber. The system also includes a source of high velocity air and a manifold for directing an effective curtain of high velocity air across the top opening and down into the combustion chamber.

The heat recovery system comprises a system of tubing for conveying a heat conductive medium through the tubing during the combustion process. The tubing may be mounted to the walls, mounted inside the walls, or formed integrally in the walls. The tubing is preferably disposed in serpentine fashion through the walls such that maximum heat transfer between the combustion chamber and the heat conducting medium occurs during the time that the medium is conveyed through the tubing. The walls are preferably divided into individual panels that are lined with a refractory material. Each panel carries an individual section of tubing having a fitting for an input and an output. Accordingly, the tubing system for the panels may be connected in series or parallel depending on the heating requirements of the specific application.

The heat conducting medium may comprise a liquid, gas or multi phase substance that may be used for many different applications. Some waste treatment sites have retention ponds with microorganisms for cleaning up the water in the retention pond. Water cycled through the tubing system of the present invention at the incinerator may be conveyed to the retention pond where the heated water provides for heating the ponds in order to optimize the activity of the microorganisms.

As an alternative, the heat conducting medium that passes through,the pipe system during combustion may be used to provide a source of convective heat for equipment or facilities located near the portable incinerator.

Also, the heat conducting medium may provide an input for manufacturing process that require a preheated liquid or gas.

Finally, it is also possible in some applications to have the pipes connected in series to produce steam for suitable steam-powered processes.

BRIEF DESCRIPTION OF THE DRAWINGS

The invention is illustrated in the drawings in which like reference characters designate the same or similar parts throughout the figures of which.

DESCRIPTION OF THE PREFERRED EMBODIMENTS

Figure 1:
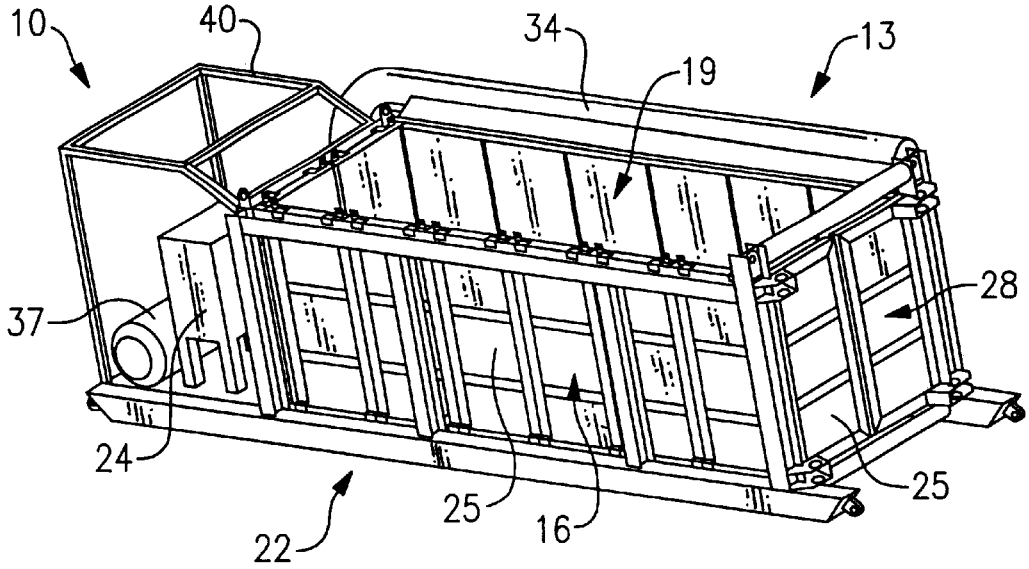
FIG. 1 is a perspective view of a portable incineration apparatus.
Figure 2:
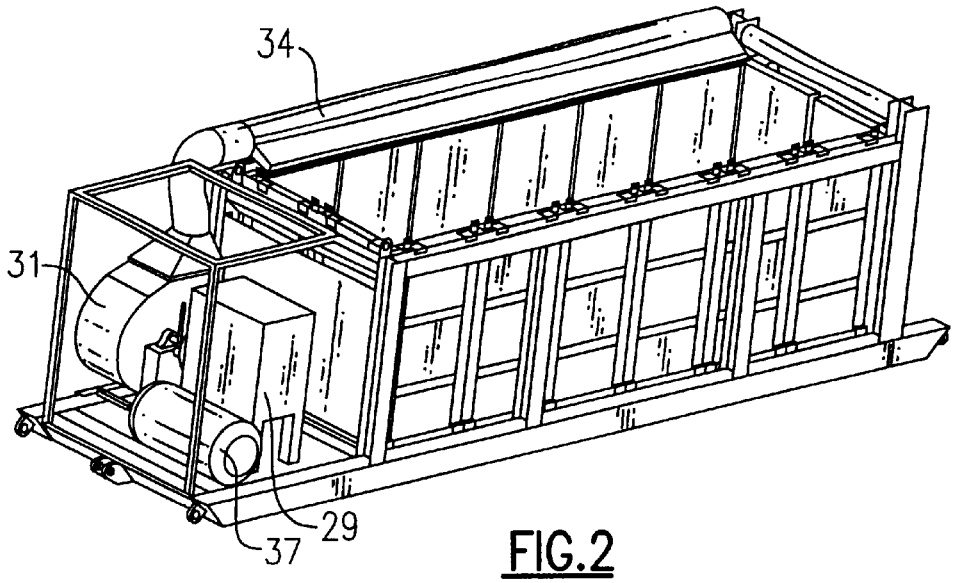
FIG. 2 is a different perspective view of the portable incineration apparatus shown in FIG. 1.

Referring to FIGS. 1–2, a portable incineration apparatus 10 suitable for use in the present invention is shown. The portable incineration apparatus is described in detail in U.S. Pat. No. 5,415,113 to Wheeler et al., which is assigned to the assignee of the present invention and which is incorporated herein by reference. The apparatus 10 provides a box 13 having four walls 16 with a top opening 19 and a bottom opening 22.

Each wall 16 is lined on the inside with a layer of refractory material in the form of refractory panels 25. The inside of the doors 28 at the end of the unit are similarly lined with a refractory panel 25. Each panel 25 is preferably constructed with ⅜"×4"×4" steel angle having ⅜"×2" flat bar back supports and ¼" thick 304 stainless steel holding clips all continuously welded into a suitably sized sub-frame. Each sub-frame is poured solid 4" thick with a 2800° F. rated refractory material that is castable and strengthened with stainless steel needles. Satisfactory results have been obtained using a refractory material named Kaocrete 28-LI "RFT" filled with stainless steel needles.

An internal combustion engine 29 which may use gasoline or diesel fuel is mounted on the apparatus 10 and provides a preferred power source for the portable apparatus. The engine 29 drives a shaft (not shown) of a fan 31 through a suitable speed reducer as known to those of ordinary skill in the art. The fan 31 conveys air at high velocities through a manifold 34 disposed adjacent to the top of the apparatus 10. A fuel tank 37 containing a supply of fuel for the engine 29 is also mounted to the apparatus 10. A cover 40 protects the engine 29 and fan 31 from exposure to the elements.

Figure 3:
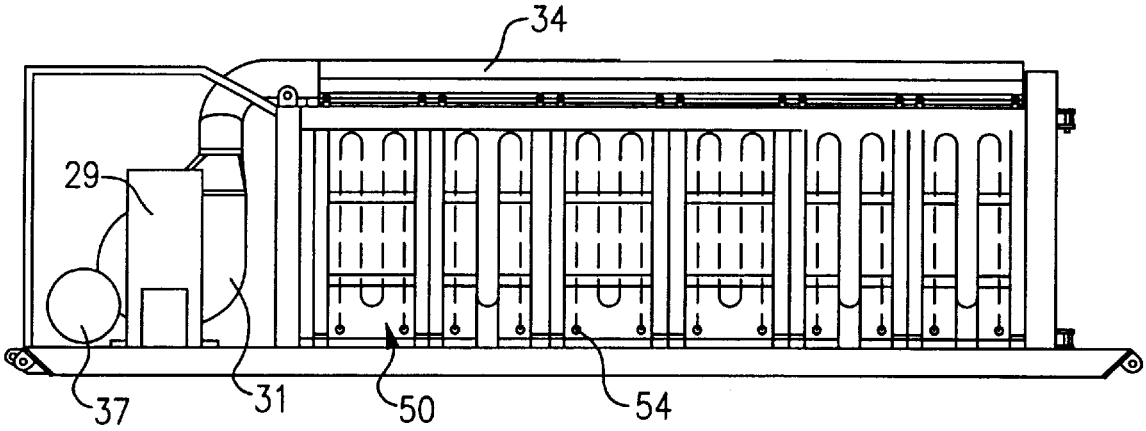
FIG. 3 is a side elevational view of a portable incineration apparatus equipped with the heat recovery apparatus of the present invention.
Figure 4:
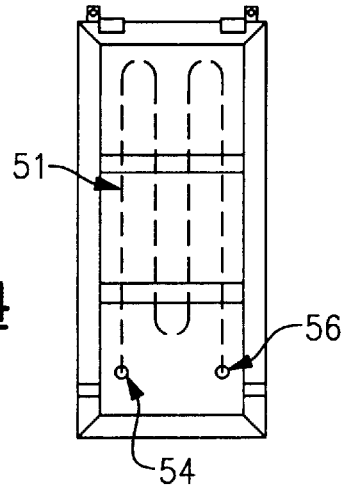
FIG. 4 is a side elevation view of a panel.

Turning to FIGS. 3 and 4, a system of tubing 50 for conveying a heat conductive medium is mounted on the walls 16. The tubing 50 may be mounted to the walls 16 in numerous ways. First, the tubing 50 may be attached to the outside of the walls 16 by suitable support and fastening systems such as heat resistant brackets and the like. Second, the tubing 50 may be embedded inside the refractory material in the panels 25. Finally, as an alternative embodiment, the tubing 50 located at or on the panels 25 can be eliminated and passages for the fluid may be integrally formed inside the refractory panels 25 during the casting process. Accordingly, the panels 25 may be cast with forms such that cavities (not shown) are formed inside the refractory material during the process as known to those of ordinary skill in the art. The cavities are formed to be capable of conveying a heat conducting medium there through. Ports for entry and exit of the heat conducting medium are tapped in the outside of the panels 25 and fittings for connecting to the tubing are attached thereto, as known to those of skill in the art.

The tubes 50 or integrally formed path in the panels 25 are preferably formed in serpentine fashion on the side walls 16 such that heat transfer is optimized. Each panel 25 is preferably provided with a discreet tubing section 51 extending there through. Each tube has an input 54 and an output portion 56 provided with suitable fittings for attaching conveying lines 59 thereto. The tubing sections 51 may be connected in series or in parallel depending on the heat transfer requirements of the particular application.

Figure 5:
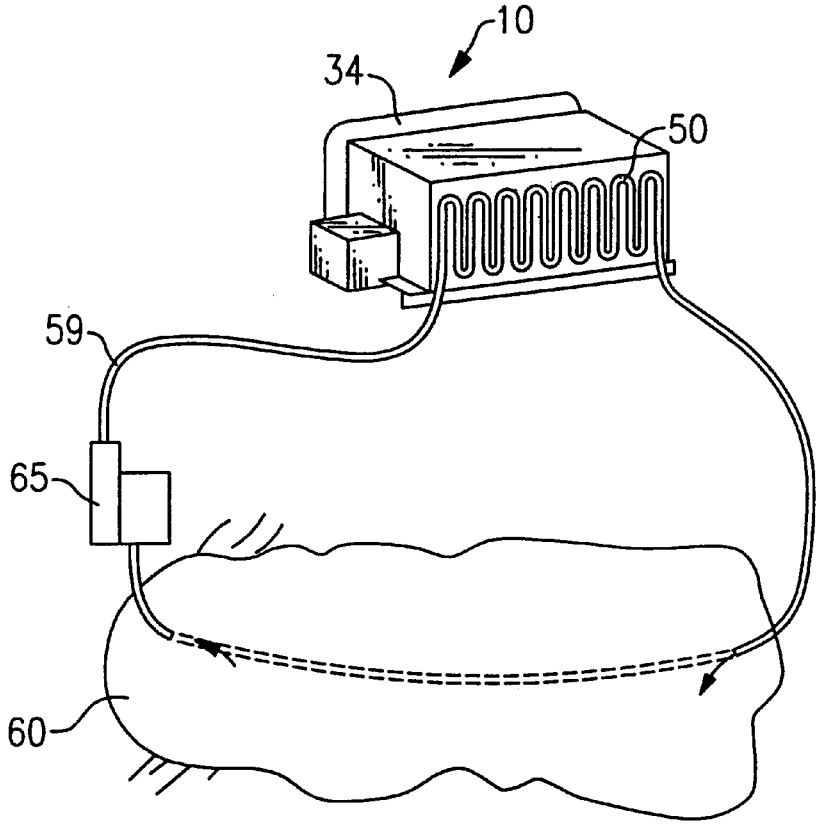
FIG. 5 is a schematic diagram illustrating the method of the present invention whereby heat is recovered and reused for warming a retention pond; and, FIG. 6 is a schematic diagram illustrating the method of the present invention whereby heat is recovered and reused for a convective heating system to provide heat to a facility located near the portable incineration apparatus.

In FIG. 5, an application of the present invention to a retention pond 60 is shown. Retention ponds 60 for treating wastewater or other effluent may include microorganism that clean the water. In many instances, the microorganisms are more active and therefore more efficient at cleaning the water in warmer temperatures. Accordingly, the retention pond 60 may be equipped with an open or closed heat transfer system whereby a pump 65 conveys fluid through the conveying lines 59 in a closed circuit as shown in phantom lines or in an open circuit as shown in FIG. 5. In a closed circuit, the conveying lines 59 would convey a heat transfer medium through a closed pipe system. In an open system, the water from the retention pond 60 would be cycled through the system by an outdoor pump such that water from the pond is picked up through an intake and circulated through the tubing 50 until it is released back into the pond at the other end of the conveying line 59.

Figure 6:
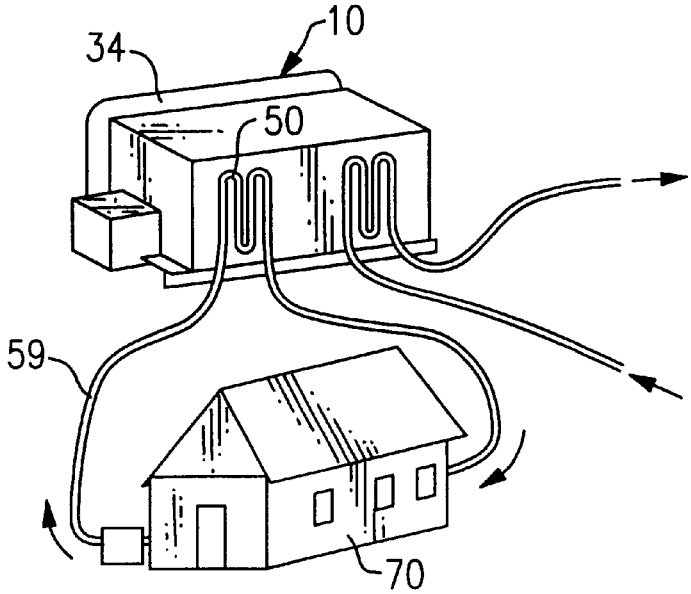

In FIG. 6, another application of the present invention is shown. The heating of a building 70 may be supplemented by the heat recovered by the present invention. A heat transfer medium is conveyed through a convective heating system such that heat picked up by the heat transfer medium while it passes through tubing 50 is transported into a convective heating system such as a radiator located inside the building. The heated liquid or gas transfers heat to the air inside the building through a convective heating process as known to those of ordinary skill in the art.

While the invention has been described in connection with certain preferred embodiments, it is not intended to limit the scope of the invention to the particular forms set forth, but, on the contrary, it is intended to cover such alternatives, modifications, and equivalents as may be included within the spirit and scope of the invention as defined by the appended claims.

What is claimed is:

1. A portable incineration apparatus and heat recovery system, comprising:

a transportable box defined by a plurality of walls and having an open top and an open bottom, said walls lined with a refractory material and operatively associated with said open bottom to form a combustion chamber;

a source of high velocity air;

a manifold assembly in air transfer communication with said source of high velocity air, said manifold assembly being adapted to direct an effective curtain of high velocity air across said top opening and down into said combustion chamber;

a conduit disposed on at least one of the plurality of walls;

a heat conductive medium disposed in fluid communication with the conduit so that the medium passes through the conduit during combustion; and, a pump and a pipe disposed in fluid communication with the conduit, the pipe disposed through a retention pond.

2. The portable incineration apparatus and heat recovery system of claim 1, wherein the conduit is attached to at least one of the plurality of walls.

3. The portable incineration apparatus and heat recovery system of claim 1, wherein the conduit is integrally formed in at least one of the plurality of walls.

4. The portable incineration apparatus and heat recovery system of claim 1, wherein at least one of the plurality of walls is formed from a plurality of panels.

5. The portable incineration apparatus and heat recovery system of claim 4, wherein each panel includes a frame surrounding a refractory material.

6. The portable incineration apparatus and heat recovery system of claim 4, wherein a section of the conduit having an inlet and an outlet is disposed in each panel so that the panels can be connected by tubing in a series or parallel configuration.

7. The portable incineration apparatus and heat recovery system of claim 1, wherein the conduit is disposed through at least one of the walls in serpentine fashion.

8. A portable incineration apparatus and heat recovery system, comprising:

a transportable box defined by a plurality of walls and having an open top and an open bottom, said walls lined with a refractory material and operatively associated with said open bottom to form a combustion chamber;

a source of high velocity air;

a manifold assembly in air transfer communication with said source of high velocity air, said manifold assembly being adapted to direct an effective curtain of high velocity air across said top opening and down into said combustion chamber;

a conduit disposed on at least one of the plurality of walls;

a heat conductive medium disposed in fluid communication with the conduit so that the medium passes through the conduit during combustion; and, a pump and a pipe disposed in fluid communication with the conduit, the pipe disposed in fluid communication with a convective heating system for heating air in a building.

9. A portable incineration apparatus and heat recovery system, comprising:

means for forming a transportable combustion chamber;

means for generating high velocity air;

a manifold assembly in air transfer communication with said generating means, the manifold assembly being adapted to direct an effective curtain of high velocity air into the combustion chamber;

a conduit having an inlet and an outlet and disposed on the forming means;

a heat conductive medium disposed in fluid communication with the conduit so that the medium has a first temperature at the inlet and a second temperature at the outlet, the second temperature being greater than the first temperature during combustion; and, a pump and a pipe disposed in fluid communication with the conduit, the pipe disposed through a retention pond.

10. A method of recovering heat from a portable incineration apparatus, the method comprising:

providing a transportable box defined by a plurality of walls and having an open top and an open bottom, said walls lined with a refractory material operatively associated with said open bottom to form a combustion chamber, a source of high velocity air, a manifold assembly in air transfer communication with said source of high velocity air, said manifold assembly being adapted to direct an effective curtain of high velocity air across said top opening and down into said combustion chamber, a conduit disposed on at least one of the plurality of walls, a heat conductive medium disposed in fluid communication with the conduit;

circulating a heat conductive medium through the conduit during combustion; and, wherein the heat conductive medium is conveyed to a retention pond after the medium passes through the conduit.

11. The method of claim 10, wherein the conduit is an open loop system.

12. The method of claim 10, wherein the conduit is a closed loop system.

13. A method of recovering heat from a portable incineration apparatus, the method comprising:

providing a transportable box defined by a plurality of walls and having an open top and an open bottom, said walls lined with a refractory material operatively associated with said open bottom to form a combustion chamber, a source of high velocity air, a manifold assembly in air transfer communication with said source of high velocity air, said manifold assembly being adapted to direct an effective curtain of high velocity air across said top opening and down into said combustion chamber, a conduit disposed on at least one of the plurality of walls, a heat conductive medium disposed in fluid communication with the conduit;

circulating a heat conductive medium through the conduit during combustion; and, wherein the heat conductive medium is conveyed to a convective heating system for heating air inside a building.

14. The method of claim 10, wherein the conduit is attached to at least one of the plurality of walls.

15. The method of claim 10, wherein the conduit is integrally formed in at least one of the plurality of walls.

16. The method of claim 10, wherein at least one of the plurality of walls is formed from a plurality of panels.

17. The method of claim 16, wherein each panel includes a frame surrounding a refractory material.

18. The method of claim 10, wherein a section of the conduit having an inlet and an outlet is disposed in each panel so that the panels can be connected in a series or parallel configuration.

* * * * *